US011679523B2

(12) United States Patent
Kopelas et al.

(10) Patent No.: US 11,679,523 B2
(45) Date of Patent: Jun. 20, 2023

(54) COUPLING SYSTEM

(71) Applicant: Bic Violex S.A., Anoixi (GR)

(72) Inventors: Panagiotis Kopelas, Anoixi (GR); Georgios Georgakis, Anoixi (GR); Sam Pearce, Nottinghamshire (GB)

(73) Assignee: BIC Violex Single Member S.A., Anoixi (GR)

( * ) Notice: Subject to any disclaimer, the term of this patent is extended or adjusted under 35 U.S.C. 154(b) by 124 days.

(21) Appl. No.: 17/117,482

(22) Filed: Dec. 10, 2020

(65) Prior Publication Data

US 2021/0187769 A1 Jun. 24, 2021

(30) Foreign Application Priority Data

Dec. 23, 2019 (EP) ..... 19219253

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
CPC ..... B26B 21/10; B26B 21/14; B26B 21/225; B26B 21/40; B26B 21/4012; B26B 21/4068; B26B 21/4075; B26B 21/52; B26B 21/521
USPC ..... 30/47–51, 526, 527
See application file for complete search history.

(56) References Cited

U.S. PATENT DOCUMENTS

| | | | | |
|---|---|---|---|---|
| 4,926,553 | A * | 5/1990 | Miskin | B26B 21/225 30/49 |
| 5,787,586 | A | 8/1998 | Apprille, Jr. | |
| 7,690,122 | B2 * | 4/2010 | Worrick, III | B26B 21/521 30/526 |
| 9,327,415 | B1 | 5/2016 | Hovsepian | |
| 10,807,261 | B2 * | 10/2020 | Zaremba | B26B 21/521 |
| 10,952,518 | B1 * | 3/2021 | Kosloff | A45D 34/00 |
| 11,034,038 | B2 * | 6/2021 | Chang | B26B 21/521 |
| 11,052,558 | B2 * | 7/2021 | Lee | B26B 21/521 |
| 11,117,279 | B2 * | 9/2021 | Georgakis | B26B 21/225 |
| 11,220,016 | B2 * | 1/2022 | Gratsias | B26B 21/521 |
| 11,298,845 | B2 * | 4/2022 | Zucker | B26B 21/521 |
| 11,351,687 | B2 * | 6/2022 | Bunnell | B26B 21/521 |

(Continued)

FOREIGN PATENT DOCUMENTS

EP 3623121 A1 3/2020

OTHER PUBLICATIONS

European Search Report in corresponding European Application No. EP19219253, dated May 14, 2020, (6 pages).

*Primary Examiner* — Jason Daniel Prone
(74) *Attorney, Agent, or Firm* — Bookoff McAndrews, PLLC

(57) ABSTRACT

A coupling mechanism for a shaving device having a first connector coupled with a second connector defining a channel, the second connector including an engagement surface within the channel. A retainer positioned between the first connector and the second connector, and a plunger that transitions between a first position and a second position. The engagement surface of the second connector engages the retainer when the plunger is in the first position and the engagement surface of the second connector disengages the retainer when the plunger is in the second position.

16 Claims, 4 Drawing Sheets

(56) References Cited

U.S. PATENT DOCUMENTS

| | | | | |
|---|---|---|---|---|
| 2002/0026721 | A1* | 3/2002 | Lee | B26B 21/225 30/527 |
| 2008/0034589 | A1* | 2/2008 | Nearing | B26B 21/40 30/32 |
| 2013/0145626 | A1* | 6/2013 | Xu | B26B 21/4068 30/41 |
| 2015/0328788 | A1 | 11/2015 | Ren et al. | |
| 2016/0001455 | A1* | 1/2016 | Swenson | B26B 21/225 30/57 |
| 2017/0036363 | A1* | 2/2017 | Efthimiadis | B26B 21/521 |
| 2017/0326744 | A1* | 11/2017 | Liberatore | B26B 21/521 |
| 2018/0264667 | A1 | 9/2018 | Chang et al. | |
| 2020/0039098 | A1* | 2/2020 | Kopelas | B26B 21/225 |
| 2020/0070376 | A1* | 3/2020 | Petratou | B26B 21/521 |
| 2020/0180177 | A1* | 6/2020 | Bunnell | B26B 21/521 |
| 2021/0008745 | A1* | 1/2021 | Kruemke | B26B 21/521 |
| 2021/0122072 | A1* | 4/2021 | Ntavos | B26B 21/521 |
| 2021/0129365 | A1* | 5/2021 | Kopelas | B26B 21/521 |
| 2021/0187768 | A1* | 6/2021 | Lee | B26B 21/521 |
| 2021/0187770 | A1* | 6/2021 | Malliaros | B26B 21/521 |
| 2021/0245376 | A1* | 8/2021 | Ntavos | B26B 21/521 |
| 2021/0283792 | A1* | 9/2021 | Lee | B26B 21/14 |
| 2021/0339416 | A1* | 11/2021 | Kopelas | B26B 21/521 |
| 2021/0354321 | A1* | 11/2021 | Kopelas | B26B 21/225 |
| 2021/0354322 | A1* | 11/2021 | Kopelas | B26B 21/225 |
| 2021/0379777 | A1* | 12/2021 | Kopelas | B26B 21/521 |
| 2022/0001560 | A1* | 1/2022 | Good | B26B 21/521 |
| 2022/0143854 | A1* | 5/2022 | Jungnickel | B26B 21/521 |

* cited by examiner

COUPLING SYSTEM

This application claims benefit from European Patent Application EP 19219253.2 filed on 23 Dec. 2019, its content being incorporated herein by reference.

FIELD

The present disclosure relates generally to the field of skincare, and in particular to shaving. More specifically, the present disclosure relates to a coupling system for connecting a replaceable shaving cartridge of a shaving device to a handle of a shaving device.

BACKGROUND ART

A typical handheld shaving device includes a handle and replaceable shaving cartridges or heads which are configured to connect to the handle via a coupling system. The coupling system should provide for a safe and secure coupling and decoupling of the replaceable shaving cartridge to and from the handle, while also ensuring that the coupling and decoupling of the replaceable shaving cartridge to and from the handle is a smooth and seamless experience for a user. A given shaving device may utilize a coupling system which is specific to that given shaving device, which can complicate the assembly process when a manufacturer offers a wide variety of shaving devices.

It is desirable to provide an improved coupling system for connecting a replaceable shaving cartridge of a shaving device to a handle of a shaving device that fulfills one or more of the needs described above.

SUMMARY

According to aspects of the present disclosure, a coupling system for a shaving device comprises a first connector, a second connector, a retainer, and a plunger, the first connector is configured to couple with the second connector which defines a channel, the second connector includes an engagement surface within the channel, the retainer is configured to be positioned between the first connector and the second connector, and the plunger is configured to transition between a first position and a second position, the engagement surface of the second connector is configured to engage the retainer when the plunger is in the first position and the engagement surface of the second connector and the retainer are configured to disengage when the plunger is in the second position.

According to aspects of the present disclosure, the first connector may include a guide portion and the plunger may move within the guide portion between the first and second positions.

According to aspects of the present disclosure, the plunger may include a support surface and a relief surface, the support surface may be distanced a first distance D1 from the guide portion, the relief surface may be distanced a second distance D2 from the guide portion, and the second distance D2 may be greater than the first distance D1.

According to aspects of the present disclosure, a gap may be defined between the first connector and the relief surface when the plunger is in the second position.

According to aspects of the present disclosure, the plunger may be configured to support the retainer when the plunger is in the first position and the plunger may not support the retainer when the plunger is in the second position.

According to aspects of the present disclosure, the first connector may include a window allowing the retainer to be supported by the plunger when the plunger is in the first position.

According to aspects of the present disclosure, the retainer may be capable of projecting to a position below the window when the plunger is in the second position.

According to aspects of the present disclosure, the engagement surface of the second connector may be located within a groove of the second connector within the channel of the second connector.

According to aspects of the present disclosure, the retainer may be elastically deformable.

According to aspects of the present disclosure, the retainer may be positioned radially about the first connector.

According to aspects of the present disclosure, the retainer may be secured within a groove included about an exterior of the first connector.

According to aspects of the present disclosure, the second connector may include an inner wall and the plunger may exert a force on the inner wall in the second position.

According to aspects of the present disclosure, the first connector may be configured to be received within the channel of the second connector.

According to aspects of the present disclosure, the second connector may include a displacement surface configured to elastically deform the retainer.

According to aspects of the present disclosure, transition of the plunger from the first position to the second position may be caused by a user manipulating a button.

In the manner described and according to aspects illustrated herein, the coupling system may be configured to connect a replaceable shaving cartridge of a shaving device to a handle of a shaving device while addressing one or more needs such as making the coupling and decoupling a smooth and seamless experience for a user and simplifying the assembly process of the coupling system, and thus a handheld shaving device, for a manufacturer.

Further aspects of the present disclosure provide for a coupling system for a shaving device that comprises a first connector configured to couple with a second connector defining a channel, the second connector including an engagement surface within the channel. The coupling system further comprising a retainer configured to be positioned between the first connector and the second connector; the retainer being elastically deformable such that the retainer allows the first and second connector to transition between a coupled state and uncoupled state.

In examples, in the coupled state, the first connector may be securely coupled to the second connector in a locked relationship and in the uncoupled state, the first connector may be decoupled from the second connector and the second connector may be ejected or released from the locked relationship with the first connector.

In examples, the coupling system may further comprise a plunger configured to transition between a first position and a second position, the engagement surface of the second connector may be configured to engage the retainer when the plunger is in the first position and the engagement surface of the second connector and the retainer may be configured to disengage when the plunger is in the second position.

According to still further aspects the present disclosure provides for a handle for a shaving device is provided. The handle comprises a coupling system substantially as disclosed herein that is configured to connect a replaceable shaving cartridge to the handle.

BRIEF DESCRIPTION OF THE DRAWINGS

Aspects of an embodiment will be described in reference to the drawings, where like numerals reflect like elements.

DETAILED DESCRIPTION

Figure 1:
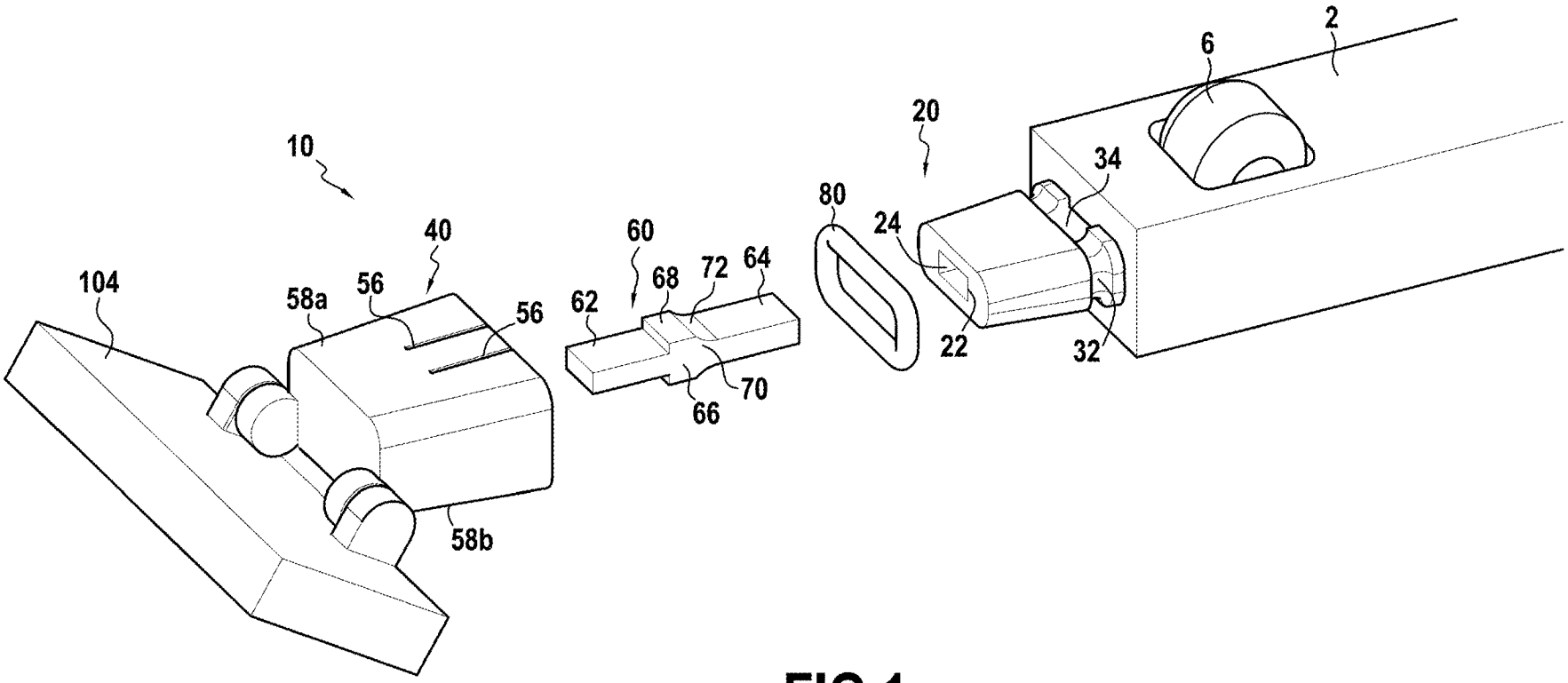
FIG. 1 is an exploded perspective view of the coupling system according to aspects of the disclosure.

An embodiment of the coupling system according to aspects of the disclosure will now be described with reference to FIGS. 1-8, wherein like numerals represent like parts, and will generally be referred to by the reference numeral 10. Although the coupling system 10 is described with reference to specific examples, it should be understood that modifications and changes may be made to these examples without going beyond the general scope as defined by the claims. In particular, individual characteristics of the various embodiments shown and/or mentioned herein may be combined in additional embodiments. Consequently, the description and the drawings should be considered in a sense that is illustrative rather than restrictive. The Figures, which are not necessarily to scale, depict illustrative aspects and are not intended to limit the scope of the disclosure. The illustrative aspects depicted are intended only as exemplary.

The term "exemplary" is used in the sense of "example," rather than "ideal." While aspects of the disclosure are amenable to various modifications and alternative forms, specifics thereof have been shown by way of example in the drawings and will be described in detail. It should be understood, however, that the intention is not to limit aspects of the disclosure to the particular embodiment(s) described. On the contrary, the intention of this disclosure is to cover all modifications, equivalents, and alternatives falling within the scope of the disclosure.

Various materials, methods of construction and methods of fastening will be discussed in the context of the disclosed embodiment(s). Those skilled in the art will recognize known substitutes for the materials, construction methods, and fastening methods, all of which are contemplated as compatible with the disclosed embodiment(s) and are intended to be encompassed by the appended claims.

As used in this disclosure and the appended claims, the singular forms "a," "an," and "the" include plural referents unless the content clearly dictates otherwise. As used in this disclosure and the appended claims, the term "or" is generally employed in its sense including "and/or" unless the content clearly dictates otherwise.

Throughout the description, including the claims, the terms "comprising a," "including a," and "having a" should be understood as being synonymous with "comprising one or more," "including one or more," and "having one or more" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially," "approximately," and "generally" should be understood to mean falling within such accepted tolerances.

When an element or feature is referred to herein as being "on," "engaged to," "connected to," or "coupled to" another element or feature, it may be directly on, engaged, connected, or coupled to the other element or feature, or intervening elements or features may be present. In contrast, when an element or feature is referred to as being "directly on," "directly engaged to," "directly connected to," or "directly coupled to" another element or feature, there may be no intervening elements or features present. Other words used to describe the relationship between elements or features should be interpreted in a like fashion (e.g., "between" versus "directly between," "adjacent" versus "directly adjacent," etc.).

Spatially relative terms, such as "top," "bottom," "middle," "inner," "outer," "beneath," "below," "lower," "above," "upper," and the like, may be used herein for ease of description to describe one element or feature's relationship to another element(s) or feature(s) as illustrated in the drawings. Spatially relative terms may be intended to encompass different orientations of a device in use or operation in addition to the orientation depicted in the drawings. For example, if the device in the drawings is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although the terms "first," "second," etc. may be used herein to describe various elements, components, regions, layers, sections, and/or parameters, these elements, components, regions, layers, sections, and/or parameters should not be limited by these terms. These terms are only used to distinguish one element, component, region, layer, or section from another region, layer, or section. Thus, a first element, component, region, layer, or section discussed herein could be termed a second element, component, region, layer, or section without departing from the teachings of the present disclosure.

Figure 7:
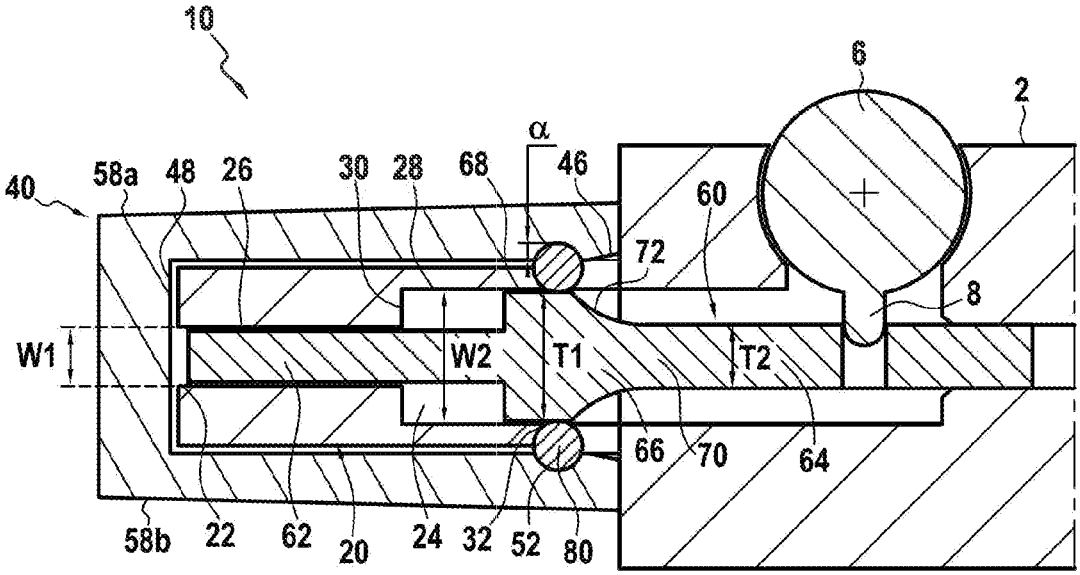
FIG. 7 is a side cross sectional view of the coupling system of FIG. 1, illustrating the first connector and the second connector of the coupling system of FIG. 1 in the coupled state and the plunger of the coupling system of FIG. 1 in the first position.
Figure 8:
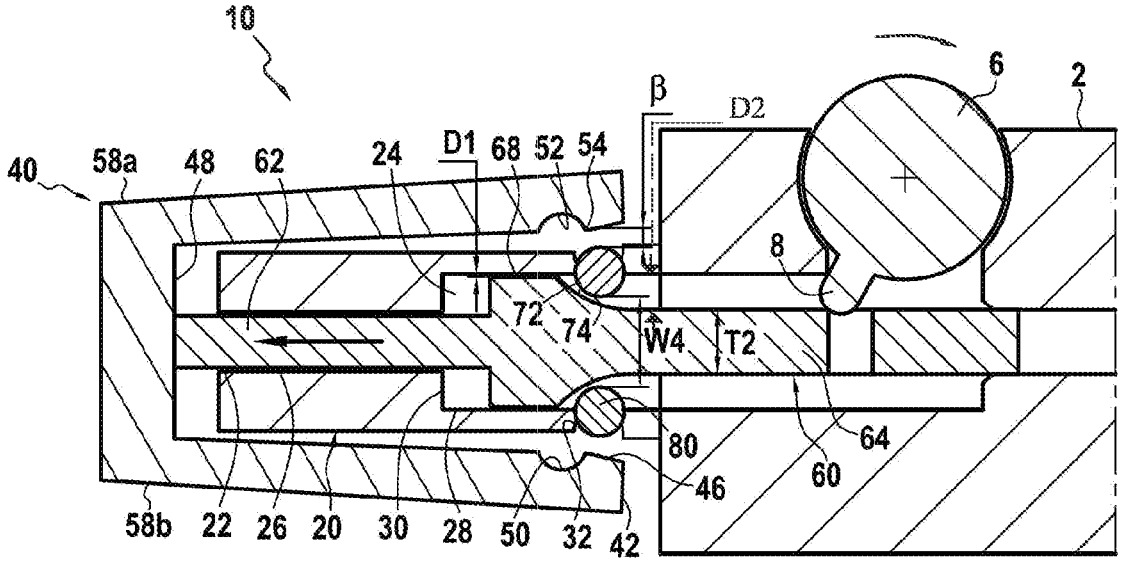
FIG. 8 is a side cross sectional view of the coupling system of FIG. 1, illustrating the first connector and the second connector of the coupling system of FIG. 1 transitioning between the coupled state and the uncoupled state and the plunger of the coupling system of FIG. 1 in the second position.

The coupling system 10 may be configured to couple parts of a product (hereafter, "the product"), such as a handheld shaving device having a handle (first part) 2 and a head/replacing shaving cartridge (second part) 104. As shown in FIG. 1, the coupling system 10 may include minimal components to simplify manufacturing, such as a first connector 20, a second connector 40, a plunger 60, and an elastically deformable retainer 80. In the disclosed embodiment, the handle 102 may include a button 6 and an extension 8 (see FIGS. 7 and 8) configured to actuate and/or cause movement of the plunger 60, however, it is contemplated that other actuation techniques such as a spring-loaded system or manual movement of the plunger 60 by a user may be compatible with the coupling system 10. As illustrated by FIGS. 7 and 8, depression or rotation of the button 6 may cause the extension 8 to urge and/or move the plunger 60 in a first direction away from the handle 2. In the disclosed embodiment, the first connector 20 may be attached to the handle 2 of the product and the second connector 40 may be attached to the head 104 of the product, however, it is contemplated that the first connector 20 may be attached to the head 104 and the second connector 40 may be attached to the handle 2. In the disclosed embodiment, the first and second connectors 20, 40 may be integrally formed with the handle 2 or the head 104, however, it is contemplated that the first and second connectors 20, 40 may be separate from the handle 2 and the head 104 and may attach to the handle 2 and the head 104 via an attachment connection such as a snap-fit or press-fit connection.

As shown in FIGS. 1-6, the first connector 20 and the second connector 40 may be configured to transition between a coupled state and an uncoupled state. In the coupled state, the first connector 20 is securely coupled to the second connector 40 in a locked relationship. In the uncoupled state, the first connector 20 is decoupled from the second connector 40 and the second connector 40 is ejected or released from the locked relationship with the first connector 20. The first connector 20 may define a first opening 22 extending to a first channel 24 and the second connector 40 may define a second opening 42 extending to a second channel 44. The first and second channels 22, 42 may be defined along a longitudinal axis A-A extending through the first and second connectors 20, 40. The first connector 20 may be configured to be received within the second opening 42 and the second channel 44 to couple with the second connector 40.

The first channel 24 of the first connector 20 may include a first guide portion 26 having a first width W1 leading to a second guide portion 28 having a second width W2 (see FIG. 7). The first and second guide portions 26, 28 may be defined by the dimensions of the channel. In the disclosed embodiment, the second width W2 is greater than the first width W1. In the disclosed embodiment, the second width W2 may be between 3.6 mm and 4.6 mm but, in examples, it may be 4.1 mm. The first and second guide portions 26, 28 may be configured to control movement of the plunger 60. The first channel 24 may include a shoulder 30 configured to stop movement of the plunger 60 at an intersection between the first guide portion 26 and the second guide portion 28. The first connector 20 may include a first groove (neck) 32 (see FIGS. 1 and 6) about an exterior of the first connector 20 for receiving and securely engaging the retainer 80. In the disclosed embodiment, the first groove 32 may extend radially about the first connector 20 with respect to the longitudinal axis A-A, however, it is contemplated that the first groove 32 may only be included at a top, bottom, first side and/or second side position of the first connector 20. The first groove 32 may be interrupted by a window 34 (see FIGS. 1 and 6) in communication with the first channel 22. The window 34 may allow the retainer 80 to be supported by the plunger 60. Alternatively, the first groove 32 may include a moveable tab capable of flexing into the first channel 22 to allow the retainer 80 to be supported by the plunger 60.

The second opening 42 of the second connector 40 may include an angled face 46 to provide clearance to allow the retainer 80 to be received within the second channel 44. The second channel 44 may extend from the second opening 42 to an inner wall 48 of the second connector 40. The second connector 40 may include an engagement surface 50 located within a second groove 52 within the second channel 44. The engagement surface 50 and/or the second groove 52 may be configured to receive and securely engage the retainer 80 when the plunger 60 is in a first position and disengage the retainer 80 when the plunger 60 is in a second position. Between the second groove 52 and the angled face 46, the second connector 40 may include a displacement surface 54 configured to elastically deform the retainer 80 when coupling or decoupling the first connector 20 and the second connector 40. An opening extending between the displacement surface 54 may have a width W3 that is equal to or less than a height H1 of the retainer 80 around the first connector 20 to allow the displacement surface 54 to elastically deform the retainer 80 and thereby provide for a smooth and seamless coupling and decoupling of the first connector 20 and the second connector 40. The second connector 40 may include one or more axially extending slits 56 extending from the second opening 42 to at least halfway between the second opening 42 and the inner wall 48 to allow for outward and inward flexure of the second connector 40 when receiving or being ejected from the first connector 20 and the retainer 80. In the disclosed embodiment, the second connector 40 may include a pair of slits 56 on a top (first) side 58*a* and a pair of slits 56 on a bottom (second) side 58*b*.

Referring to FIGS. 1 and 7-8, the plunger 60 may include a leading (first) segment 62, a trailing (second) segment 64, a support segment 66 having a support surface 68, and a relief segment 70 having a relief surface 72. The support segment 66 of the plunger 60 may have a first thickness T1 and the relief segment 70 of the plunger 60 may have a second thickness T2 which is less than the first thickness T1, in order to allow for room/formation of a gap 74 for the displacement surface 54 to displace the retainer 80 in the second position. In the disclosed embodiment, the first thickness T1 of the support segment 66 may be less than the second width W2 of the second guide portion 28 to allow the plunger 60 to slide within the first channel 24. In the disclosed embodiment, the first thickness T1 of the support segment 66 may be between 3.4 mm and 4.4 mm but, in examples, it may be 3.9 mm. In the disclosed embodiment, the second thickness T2 of the relief segment 70 may be between 1.8 mm and 2.8 mm but, in examples, it may be 2.3 mm. The plunger 60 may be configured to be positioned within the first channel 22 of the first connector 20. The plunger 60 may also position within the second channel 44 of the second connector 40 when the first connector 20 is coupled with the second connector 40. The plunger 60 may transition between a first position which allows for and/or causes the first connector 20 to couple with second connector 40 in the coupled state and a second position which allows for and/or causes the first connector 20 to decouple with second connector 40 when a user manipulates the button 6 to release the second connector 40 from the first connector 20. To transition from the first position to the second position, the plunger 60 may move, translate, and/or reciprocate within the first channel 24. In the disclosed embodiment, transition of the plunger 60 is caused by a user manipulating the button 6. Movement of the plunger 60 may be directed by the first and second guide portions 26, 28 of the first connector 20, to which the leading segment 62 may be directed by the first guide portion 26 and the support segment 66 may be directed by the second guide portion 28. It is contemplated that the trailing segment 64 may be directed by a third guide portion.

Figure 2:
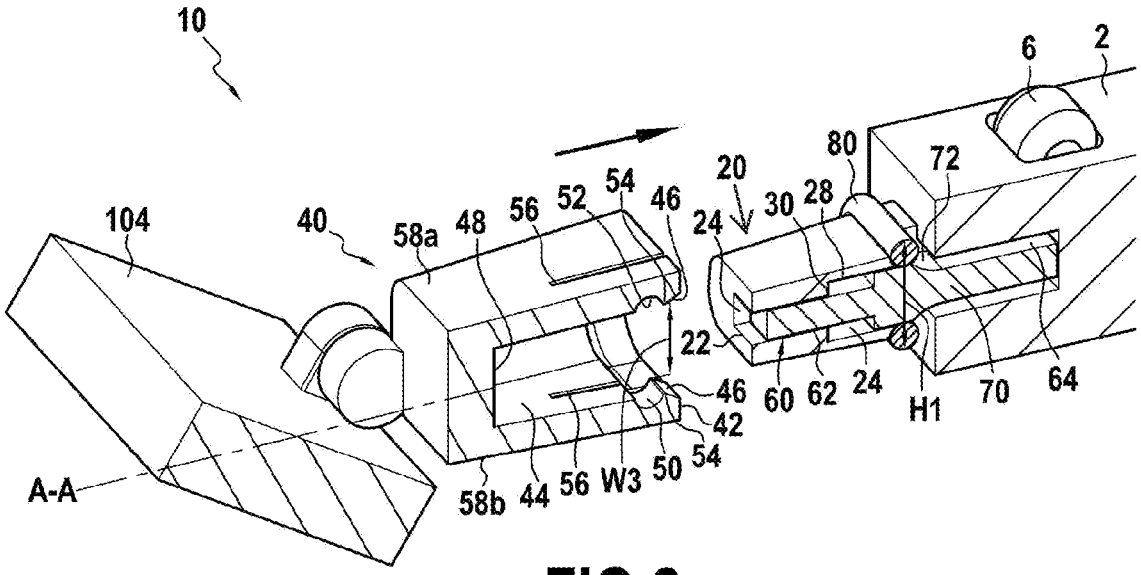
FIG. 2 is a cross-sectional perspective view of the coupling system of FIG. 1, illustrating a first connector and a second connector of the coupling system of FIG. 1 transitioning between an uncoupled state and a coupled state and a plunger of the coupling system of FIG. 1 in a first position.
Figure 3:
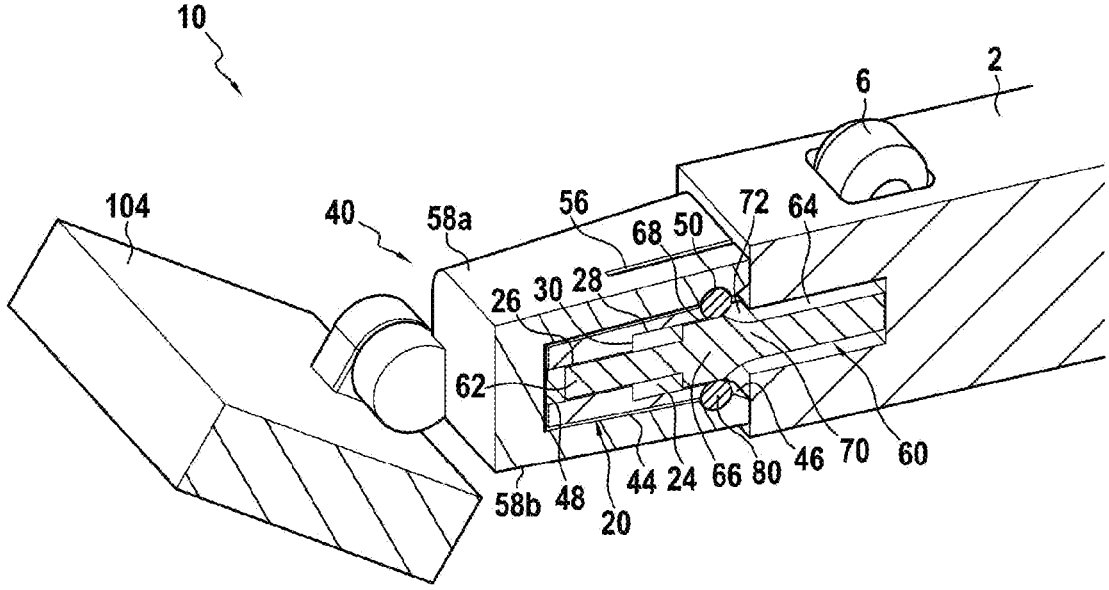
FIG. 3 is a cross-sectional perspective view of the coupling system of FIG. 1, illustrating the first connector and the second connector of the coupling system of FIG. 1 in the coupled state and the plunger of the coupling system of FIG. 1 in the first position.
Figure 4:
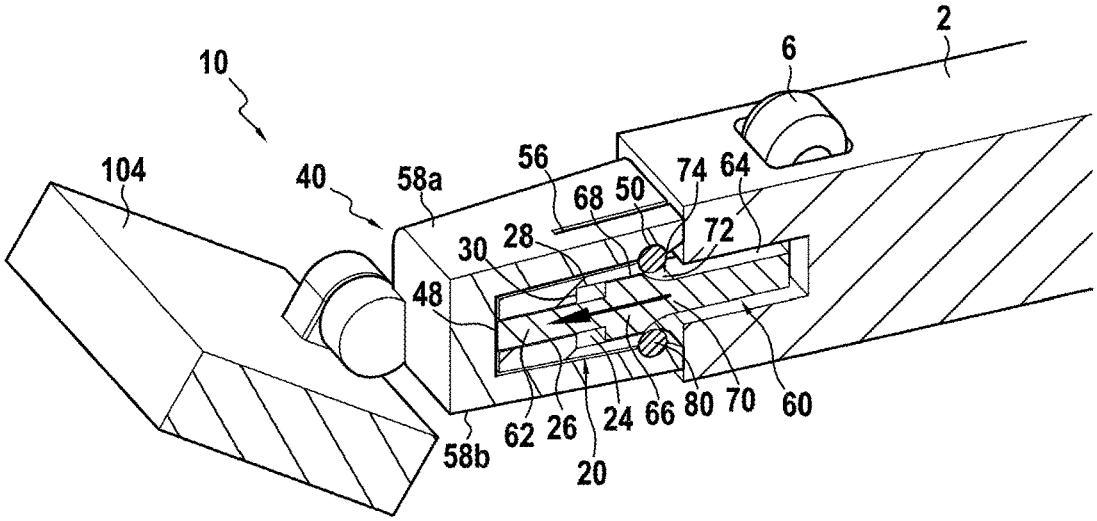
FIG. 4 is a cross-sectional perspective view of the coupling system of FIG. 1, illustrating the first connector and the second connector of the coupling system of FIG. 1 transitioning between the coupled state and the uncoupled state and the plunger of the coupling system of FIG. 1 transitioning between the first position and the second position.
Figure 5:
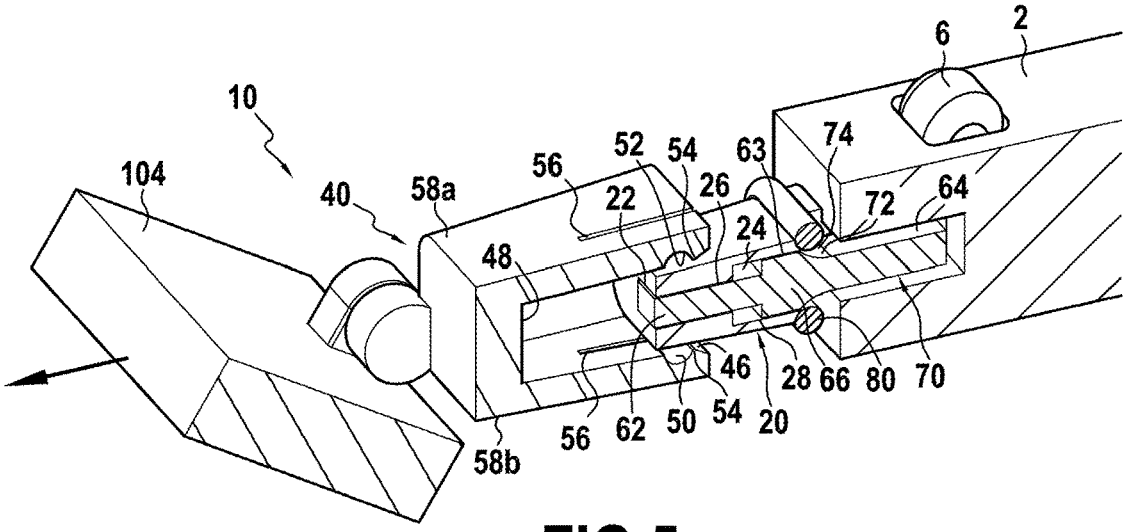
FIG. 5 is a cross-sectional perspective view of the coupling system of FIG. 1, illustrating the first connector and the second connector of the coupling system of FIG. 1 transitioning between the coupled state and the uncoupled state and the plunger of the coupling system of FIG. 1 in the second position.
Figure 6:
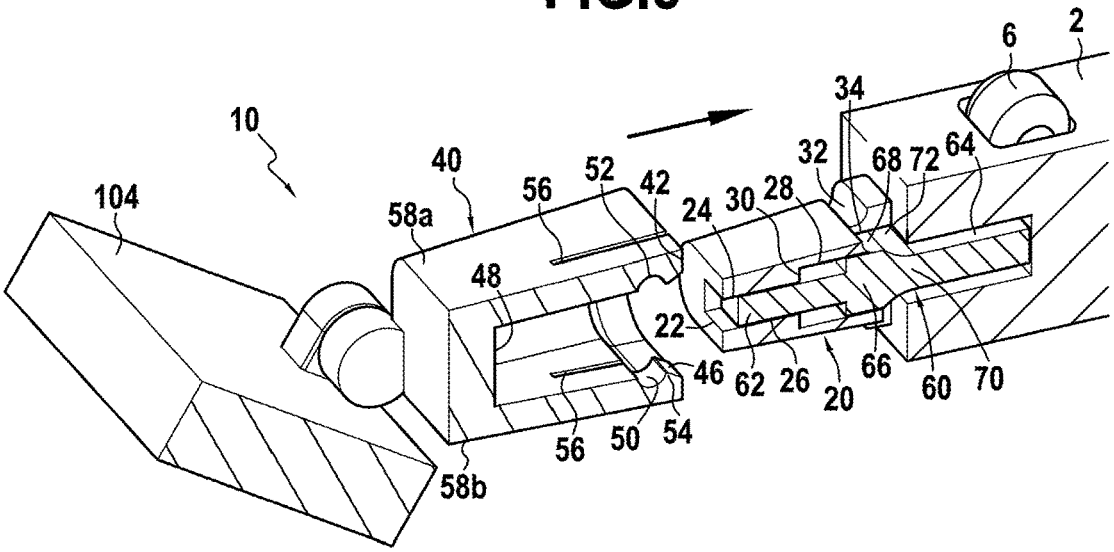
FIG. 6 is a cross-sectional perspective view of the coupling system of FIG. 1 without a retainer, illustrating the first connector and the second connector of the coupling system of FIG. 1 transitioning between the uncoupled state and the coupled state and the plunger of the coupling system of FIG. 1 in the first position.

In the first position, the support surface 68 may align with the window 34 to support the retainer 80 at or inward of the window 34 and maintain the position of the retainer 80 within the window 34 and/or within the second groove 32 (see FIGS. 2-3 and 6-7). In the first position, the retainer 80 may be deformed inwardly by the second connector 40 to a depth a (relative to the height H1 of the retainer 80) of between 0.2 mm and 1.2 mm but, in examples, it may to 0.7 mm. In the second position, the support surface 68 may no longer be aligned with the window 34 to support the retainer 80 at or inward of the window 34 and maintain the position of the retainer 80 within the window 34 and/or within the second groove 32 (see FIGS. 4-5 and 8). As shown in FIG. 8, the support surface 68 may be distanced a first distance D1 (difference between the second width W2 of the second guide portion 28 and the thickness T1 of the support segment 66) from the second guide portion 28, the relief surface 72 may be distanced a second distance D2 (difference between the second width W2 of the second guide portion 28 and the thickness T2 of the relief segment 70) from the second guide portion 28, and the second distance D2 may be greater than the first distance D1. In the disclosed embodiment, D1 may be between 0.03 mm and 0.15 mm but, in examples, it may be 0.1 mm and D2 may be between 0.04 mm and 0.13 mm but, in examples, it may be 0.9 mm. In the second position, the relief segment 70 may be aligned with the window 34. When the relief segment 70 is aligned with the window 34, a gap 74 may be defined between any of the first connector 20, the first groove 32, and/or the window 34 and the relief surface 72. The gap 74 may allow for projection and/or flexure of the deformed retainer 80 through and beneath the window 34 (see FIG. 8). In the second position, the retainer 80 may be deformed by the displacement surface 54 of the second connector 40 to a depth β between 0.2 mm and 1.2 mm but, in examples, the depth β may be 0.7 mm. In the disclosed embodiment, it is contemplated that β may be greater than or equal to a in order to allow the first and second connectors 20, 40 to unlock and transition from the coupled state to the uncoupled state. Further, β may be less than or equal to D2 in order for the deformed retainer 80 to fit within the gap 74. In the second position, the deformed retainer 80 may have an inner width W4 of between 2.0 mm and 3.0 mm but, in examples, the inner width W4 may be 2.5 mm. In the disclosed embodiment, the thickness T2 of the relief segment 70 of the plunger 60 is less than or equal to the inner width W4 of the retainer 80 to allow for flexure of the retainer 80 between the retainer 80 and the relief segment 70. As shown in FIGS. 1-3, the retainer 80 may be configured to be a part of the first connector 20. The retainer 80 may be securely affixed to the first connector 20 within the first groove 32. The retainer 80 may be configured to be elastically deformable to allow for the first and second connectors 20, 40 to transition between the coupled and uncoupled states. In the disclosed embodiment, the retainer 80 may be an O-ring constructed of an elastomeric material such as caoutchouc (natural) rubber, however, a person having ordinary skill in the art would understand that other flexible and/or polymeric materials such as synthetic rubber, nitrile rubber, silicone rubber, vinyl rubber, and/or neoprene may be compatible with the coupling system 10. In the disclosed embodiment, the retainer 80, first groove 32, and second groove 52 may extend radially in the shape of a continuous ring with respect the axis A-A, however, it is also contemplated that the retainer 80, first groove 32, and second groove 52 may extend in the shape a continuous polygon with respect to the axis A-A. In the disclosed embodiment, the retainer 80, first groove 32, and second groove 52 may have curved surfaces, however, it is contemplated that other surfaces, such as angled surfaces, may be compatible with the coupling system 10.

As illustrated by FIGS. 2, and 4-8, the plunger 60 may transition between the first position which allows for and/or causes the first connector 20 to couple with second connector 40 and the second position which allows for and/or causes the first connector 20 to decouple with second connector 40. To couple the first connector 20 and the second connector 40, a user may align the first connector 20 and the second connector 40 with respect to the axis A-A and such that the first opening 22 of the first connector 20 is facing the second opening 42 of the second connector 40 (see FIG. 2). Once aligned, the user may insert the first connector 20 through the second opening 42 and into the second channel 44 of the second connector 40. The angled face 46 of the second connector 40 may allow the user to push the retainer 80 past the second opening 42, because of the clearance provided by the angled face 46. Due to the size difference between the width W3 between the displacement surface 54 and the height H1 of the retainer 80 about the first connector 20, passing of the displacement surface 54 over the retainer 80 may elastically deform the retainer 80 as the user inserts the first connector 20 further within the second connector 40. Deformation of the retainer 80 by the displacement surface 54 may allow the retainer 80 to move past the displacement surface 54 and into the second groove 52. When the retainer 80 is in the second groove 52, the engagement surface 50 of the second groove 52 may engage the retainer 80 to hold the first connector 20 and the second connector 40 in the coupled state (see FIG. 3). Additionally, when the plunger 60 is in the first position, the support surface 68 of the plunger 60 may be tangential to and/or support the retainer 80 beneath the window 34 to hold the retainer 80 in engagement with the engagement surface 50 of the second groove 52.

To decouple the first connector 20 and the second connector 40, the user may depress or rotate the button 6 (see FIGS. 7 and 8). Depressing or rotating the button 6 may cause the extension 8 to contact the trailing segment 64 and urge and/or move the plunger 60 in a direction toward the inner wall 48 of the second connector 40, from the first position to the second position. When the plunger 60 moves in the direction toward the inner wall 48 to the second position, the support surface 68 may move within the second guide portion 28 and the relief surface 72 may move beneath the window 34. In the second position, the support surface 68 may no longer be positioned beneath the window 34 (see FIGS. 4-5 and 8). In the second position, the relief surface 72 may be positioned beneath the window 34 to define the gap 74 beneath any of the first connector 20, the first groove 32, and/or the window 34. In the second position, the leading segment 62 may apply a force on the inner wall 48 to move the second connector 40 away from the first connector 20 and eject the second connector 40 from the coupled state. The application of force on the inner wall 48 and/or a user pulling the second connector 40 away from the first connector 20 may cause the displacement surface 54 to pass over the retainer 80 to elastically deform and/or push the retainer 80 to project through the window 34, toward the relief surface 72, to a position below the window 34 (see FIG. 8). When the retainer 80 elastically deforms and projects through the window 34, toward the relief surface 72, to a position below the window 34, the retainer 80 may no longer be capable of holding the first connector 20 and the second connector 40 in the coupled state and the second connector 40 may be fully ejected or released from the first connector 20 to the uncoupled state.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

Additionally, all of the disclosed features of an apparatus may be transposed, alone or in combination, to a method and vice versa.

The invention claimed is:

1. A coupling system for a shaving device comprising:

a first connector;

a second connector configured to couple with the first connector defining a channel, the second connector including an engagement surface within the channel, and wherein the second connector includes an inner wall disposed within the channel;

a retainer configured to be positioned between the first connector and the second connector when the first connector and the second connector are coupled to one another; and a plunger configured to transition between a first position and a second position, the engagement surface of the second connector being configured to engage the retainer when the plunger is in the first position and the engagement surface of the second connector and the retainer being configured to disengage when the plunger is in the second position, and wherein the plunger exerts a force on the inner wall in the second position.

2. The coupling system of claim 1, wherein the first connector includes a guide portion and the plunger moves within the guide portion between the first and second positions.

3. The coupling system of claim 2, wherein the plunger includes a support surface and a relief surface, the support surface being distanced a first distance from the guide portion, the relief surface being distanced a second distance from the guide portion, and the second distance being greater than the first distance.

4. The coupling system of claim 3, wherein a gap is defined between the first connector and the relief surface when the plunger is in the second position.

5. The coupling system of claim 4, wherein the plunger has a first thickness and a second thickness less than the first thickness thereby allowing for formation of the gap, the gap allowing for projection and/or flexure of the retainer when in the second position.

6. The coupling system of claim 1, wherein the plunger is configured to support the retainer when the plunger is in the first position and the plunger does not support the retainer when the plunger is in the second position.

7. The coupling system of claim 1, wherein the first connector includes a window allowing the retainer to be supported by the plunger when the plunger is in the first position.

8. The coupling system of claim 7, wherein the retainer is moved to a position below the window when the plunger is in the second position.

9. The coupling system of claim 1, wherein the engagement surface of the second connector is located within a groove of the second connector within the channel of the second connector.

10. The coupling of claim 1, wherein the retainer is elastically deformable.

11. The coupling system of claim 1, wherein the retainer is positioned radially about the first connector.

12. The coupling system of claim 1, wherein the retainer is secured within a groove included about an exterior of the first connector.

13. The coupling system of claim 1, wherein the first connector is configured to be received within the channel of the second connector.

14. The coupling system of claim 1, further including;

a button, wherein the transition of the plunger from the first position to the second position is caused by a user manipulating the button.

15. The coupling system of claim 1, wherein the second connector includes a displacement surface, the displacement surface elastically deforming the retainer when transitioning between the first position and the second position via an opening, the opening extending between a first edge of the displacement surface and a second edge of the displacement surface, and wherein a width of the opening is equal to or less than a height of the retainer.

16. A coupling system for a shaving device comprising:

a first connector;

a second connector configured to couple with the first connector defining a channel, the second connector including an engagement surface within the channel, and wherein the second connector includes a displacement surface disposed within the channel;

a retainer configured to be positioned between the first connector and the second connector when the first connector and the second connector are coupled to one another, wherein the displacement surface is configured to elastically deform the retainer; and a plunger configured to transition between a first position and a second position, the engagement surface of the second connector being configured to engage the retainer when the plunger is in the first position and the engagement surface of the second connector and the retainer being configured to disengage when the plunger is in the second position.

* * * * *